US006132293A

United States Patent [19]

Littecke et al.

[11] Patent Number: 6,132,293

[45] Date of Patent: Oct. 17, 2000

[54] METHOD OF BLASTING CUTTING TOOL INSERTS

[75] Inventors: Peter Littecke, Huddinge; Anders Jonsson, Gavle, both of Sweden

[73] Assignee: Sandvik AB, Sandviken, Sweden

[21] Appl. No.: 08/077,681

[22] Filed: Jun. 16, 1993

[30] Foreign Application Priority Data

Jul. 10, 1992 [SE] Sweden ..... 9202142

[51] Int. Cl.[7] ..... B24C 1/00

[52] U.S. Cl. ..... 451/38; 451/40; 428/409; 428/547

[58] Field of Search ..... 51/319; 451/38, 451/39, 40; 75/338, 339; 428/409, 547

[56] References Cited

U.S. PATENT DOCUMENTS

| | | | |
|---|---|---|---|
| Re. 34,180 | 2/1993 | Nemeth et al. . | |
| 3,382,159 | 5/1968 | Reed | 51/319 X |
| 3,528,861 | 9/1970 | Elam et al. . | |
| 4,272,612 | 6/1981 | Oliver | 51/319 X |
| 4,282,289 | 8/1981 | Kullander et al. . | |
| 4,610,931 | 9/1986 | Nemeth et al. . | |
| 4,911,989 | 3/1990 | Minoru et al. . | |

FOREIGN PATENT DOCUMENTS

| | | |
|---|---|---|
| 88-053269 | 3/1988 | Japan . |
| 88-060279 | 3/1988 | Japan . |
| 88-060280 | 3/1988 | Japan . |

OTHER PUBLICATIONS

Patent Abstracts of Japan, vol. 14, No. 582, C–792, abstract of JP, A, 2–254144 (Nippon Steel Corp), Oct. 12, 1990.

Patent Abstracts of Japan, vol. 13, NR. 399, C 632, abstract of JP 1–142074, published Jun. 06, 1989.

Patent Abstracts of Japan, vol. 16, NR. 194, C 938, abstract of JP 4–28854, published Jan. 31, 1992.

*Primary Examiner*—P. W. Echols

*Attorney, Agent, or Firm*—Burns, Doane, Swecker & Mathis, L.LP.

[57] ABSTRACT

A method of removing the binder phase from the surface of a hard material body consisting of hard constituents in a binder phase based on cobalt and/or nickel and with a binder phase enriched surface zone is disclosed. By carrying out a blasting process using particles with a size of 400–1500 mesh, a favorable combination of even removal of the cobalt layer, essentially no damage to the carbide grains and reasonable blasting time is obtained.

4 Claims, No Drawings

METHOD OF BLASTING CUTTING TOOL INSERTS

BACKGROUND OF THE INVENTION

The present invention relates to a process for the purpose of removing the binder phase from the surface of cemented carbide inserts before applying coatings on said surface and the resulting inserts.

Coated cemented carbide inserts for machining of metals in the metal cutting industry have been commercially available for many years. Such inserts are commonly made of a metal carbide, normally WC, generally with addition of carbides of other metals such as Nb, Ti, Ta, etc., and a metallic binder phase of cobalt. By depositing onto said inserts a thin coating of a wear resistant material such as TiC, TiN, $Al_2O_3$, etc., separately or in combination, it has been possible to increase the wear resistance while maintaining essentially the same toughness. A still further improvement in properties has been obtained by subjecting the inserts to a binder phase enrichment in the surface below the coating, so-called cobalt gradient. Binder phase enrichment can be accomplished, for instance, by sintering in vacuum with nitride addition as is disclosed in U.S. Patent RE 34,180 (a reissue of U.S. Pat. No. 4,610,931), or by controlled cooling as disclosed in U.S. Pat. No. 4,911,989. Such inserts, however, often also have a thin layer of binder phase on their surface and sometimes even with a layer of graphite thereon.

The two latter layers have a negative effect on the CVD- or PVD-deposition process, which results in deposited coatings with inferior properties and insufficient adherence. These surface layers must therefore be removed before carrying out the deposition process.

Blasting of cemented carbide inserts is a common method in the art for cleaning the surface of the inserts prior to coating. The blasting is generally performed wet or dry with particles with a size of about 150 mesh. It is, of course, possible to remove said cobalt- and possible graphite-layers by such conventional blasting. However, the method is difficult to control with regard to the blasting depth, especially close to the cutting edge. In this area, the cobalt gradient zone is very easily removed which leads to an increased scatter in the properties of the final product—the coated insert. In addition, conventional blasting results in damages to the carbide grains and uneven removal of the cobalt layer which can give inferior adherence of the coating.

Chemical or electrolytic methods are alternatives for mechanical methods as disclosed in , e.g., U.S. Pat. No. 4,282,289, U.S. Pat. No. 4,911,989, JP 88-060279, JP 88-060280 and JP 88-053269. There is one serious drawback with these methods, namely, that they are incapable of only removing the cobalt layer. They also result in deep etching, particularly in areas close to the edge. As a result, an undesired porosity between the coating and the substrate is obtained in one area of the insert at the same time as the cobalt layer may partly remain in other areas of the insert. A solution to this problem is found in Swedish patent application SE 9101469-6, where is disclosed an improved method of electrolytic etching in a mixture containing concentrated sulphuric acid, $H_2SO_4$, and concentrated phosphoric acid, $H_3PO_4$. This method gives the desired effect of cleanly and effectively removing the surface layer of binder metal and any graphite from the surface of a cemented insert. An excellent surface with little cobalt and no damage to the carbide grains is obtained. However, using the method under production conditions is not completely simple. Concentrated acids have to be handled and explosive or health damaging gases and vapors may develop which have to be removed.

OBJECTS AND SUMMARY OF THE INVENTION

It is an object of this invention to avoid or alleviate the problems of the prior art.

It is further an object of this invention to provide an improved blasting method for removing the cobalt layer.

The invention provides a method of removing the binder phase from the surface of a hard material body containing hard constituents in a binder phase based on cobalt and/or nickel, said body having a binder phase enriched surface zone comprising blasting the surface zone using particles having a size of 400 to 1500 mesh and the resulting body.

DETAILED DESCRIPTION OF THE PREFERRED EMBODIMENTS OF THE INVENTION

It has now surprisingly been found that if blasting is performed using particles with a size in the range 400–1500 mesh, preferably 600–1200 mesh, a favorable combination of even removal of the cobalt layer, a favorable microstructure of the surface to be coated, essentially no damage to the carbide grains or cobalt enriched zones and reasonable blasting time is obtained. As blasting medium, $Al_2O_3$ is preferred, but also other types of substances such as SiC, $B_4C$ can also be used. The method can be wet (water being preferred as the blasting liquid) or dry. In some cases, it has been found favorable to add known viscosity-increasing substances such as glycerine, starch, etc., to the water which increases the viscosity, preferably at least 10%, of the blasting medium. The blasting conditions, e.g., pressure, angle of incidence, distance between nozzle and object, nozzle design, etc., depend on the type of machine and can be determined by experiments within the skill of the artisans. Generally, the same conditions as used for conventional blasting can be used in the process of the present invention but the blasting time has to be increased.

The invention has been described with reference to binder phase enriched cemented carbide but it can, of course, also be applied to binder phase enriched titanium-based carbonitride alloys usually called cermets.

The invention is additionally illustrated in connection with the following Examples which are to be considered as illustrative of the present invention. It should be understood, however, that the invention is not limited to the specific details of the Examples.

EXAMPLE 1

(prior art)

Cemented carbide inserts of type CNMG120408-QM with a composition of WC, 5.5% Co, 8.5% TiC+TaC+NbC and sintered in such a way that they had a 25 $\mu$m cobalt enrichment in the surface zone and with a cobalt layer of about 2 $\mu$m thickness and a graphite layer of about 2 $\mu$m thereon, were subjected to conventional wet blasting with $Al_2O_3$ with a particle size of 150 mesh in water, pressure 4 bar, angle of incidence 45°, distance between nozzle and inserts about 100 mm and blasting time a few seconds. The cemented carbide surface was severely damaged with broken carbide grains and areas of remaining cobalt.

EXAMPLE 2

Example 1 was repeated using $Al_2O_3$ with a particle size of 800 mesh and a blasting time of about 10 seconds. In this case, the carbide grains of the surface were almost undamaged and very few cobalt areas remained.

EXAMPLE 3

Example 1 was repeated using $Al_2O_3$ with a particle size of 600 mesh in a water/glycerine 60/40 mixture and a blasting time of about 10 seconds. Also in this case, the carbide grains of the surface were almost undamaged and very few cobalt area remained.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of removing the binder phase from the surface of a hard material body containing hard constituents in a binder phase based on cobalt and/or nickel, said body having a binder phase enriched surface zone comprising blasting the surface zone using particles having a size of 400 to 1500 mesh.

2. The method of claim 1 wherein said particles are taken from the group consisting of $Al_2O_3$, SiC, $B_4C$ and mixtures thereof.

3. The method of claim 1 wherein said particles are $Al_2O_3$ having a size of 600–1200 mesh and water is used as a blasting liquid.

4. The method of claim 1 wherein said particles are contained in a blasting liquid, said blasting liquid further containing a viscosity-increasing substance.

* * * * *